US005415609A

United States Patent [19]

Yang

[11] Patent Number: 5,415,609

[45] Date of Patent: May 16, 1995

[54] EXERCISING APPARATUS

[76] Inventor: Li-Hsiang Yang, No. 11, Alley 1, Lane 78, Chang Lu Road, Chang-hua, Taiwan, Taiwan, Prov. of China

[21] Appl. No.: 262,588

[22] Filed: Jun. 20, 1994

[51] Int. Cl.[6] ..... A63B 22/14

[52] U.S. Cl. ..... 482/147; 482/146; 482/123; 482/129; 297/56; 297/344.21

[58] Field of Search ..... 297/56, 344.21, 344.26, 297/461, 44, 49; 482/146, 147, 123, 129, 133

[56] References Cited

U.S. PATENT DOCUMENTS

| | | | |
|---|---|---|---|
| 1,585,748 | 5/1926 | Wendelken | 482/147 |
| 2,010,306 | 8/1935 | Leech | 297/344.21 |
| 2,738,245 | 3/1956 | Cambell | 297/344.26 |
| 3,224,530 | 12/1965 | King et al. | 297/56 |
| 3,593,994 | 7/1971 | Anbar | 482/147 |
| 4,132,405 | 1/1974 | Asher | 482/147 |
| 4,666,119 | 5/1987 | Dose | 297/56 |
| 4,743,019 | 5/1988 | Legueux | 482/147 |
| 4,787,630 | 11/1988 | Watson et al. | 482/146 |
| 4,930,771 | 6/1990 | Wilson | 482/147 |
| 4,976,425 | 12/1990 | Barnes, Jr. | 482/147 |
| 5,284,461 | 2/1994 | Wilkinson et al. | 482/147 |

*Primary Examiner*—Stephen R. Crow
*Assistant Examiner*—Jerome Donnelly
*Attorney, Agent, or Firm*—Merchant, Gould, Smith, Edell, Welter & Schmidt

[57] ABSTRACT

An exercising apparatus including a folding frame having two rectangular frames pivoted in the middle, a rotary seat hinged to one rectangular frame, and two elastic ropes having each one end respectively fastened to the folding frame at the bottom and an opposite end coupled with a respective handle, and wherein the folding frame can be alternatively set into the operative position to support the rotary seat for permitting the player to sit on the rotary seat and pull the handles, or the collapsed position closely attached to the rotary seat at the bottom for permitting the player to stand on the rotary seat and pull the handles.

2 Claims, 4 Drawing Sheets

EXERCISING APPARATUS

BACKGROUND OF THE INVENTION

The present invention relates to an exercising apparatus having two elastic ropes coupled to a folding chair for pulling.

Various exercising apparatus have been disclosed, and have appeared on the market. These exercising apparatus are commonly designed for training and exercising specific parts of the body. An exercising apparatus for multiple purposes is commonly heavy and expensive. There is a structure of exercising apparatus having a rotary disk mounted on a base frame and two elastic ropes with handles fastened to the base frame for pulling. When in exercising, the player twist the body and simultaneously pull the elastic ropes through the handles. The rotary disk has raised portions at the top so that it can rub the player's feet when exercising. This structure is functional, however it works only in one function. Another drawback of this structure of exercising apparatus is that it is not collapsible.

SUMMARY OF THE INVENTION

According to one aspect of the present invention, the exercising apparatus comprises a folding frame having two rectangular frames pivoted in the middle, a rotary seat hinged to one rectangular frame, and two elastic ropes having each one end respectively fastened to the folding frame at the bottom and an opposite end coupled with a respective handle, and wherein the folding frame can be alternatively set into the operative position to support the rotary seat for permitting the player to sit on the rotary seat and pull the handles, or the collapsed position closely attached to the rotary seat at the bottom for permitting the player to stand on the rotary seat and pull the handles.

According to another aspect of the present invention, the rotary seat comprises a circular base frame having an upright shaft at the center, and a rotary disk mounted on the circular base frame and turned about the upright shaft.

According to still another aspect of the present invention, the rotary disk has a plurality of raised portions over the top for massaging the player's feet when exercising.

DETAILED DESCRIPTION OF THE PREFERRED EMBODIMENT

Figure 1:
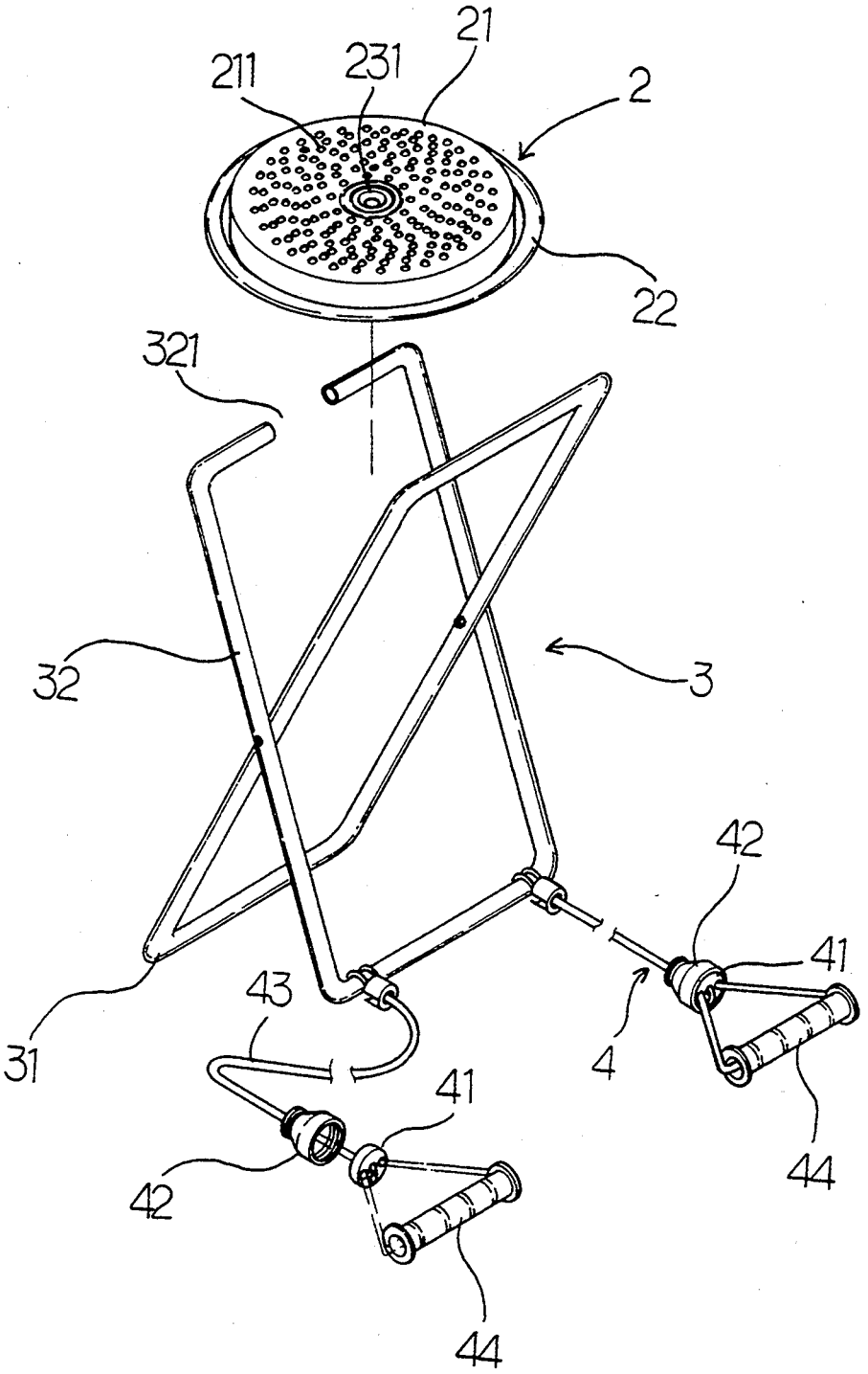
FIG. 1 is an exploded view of an exercising apparatus according to the preferred embodiment of the present invention.
Figure 2:
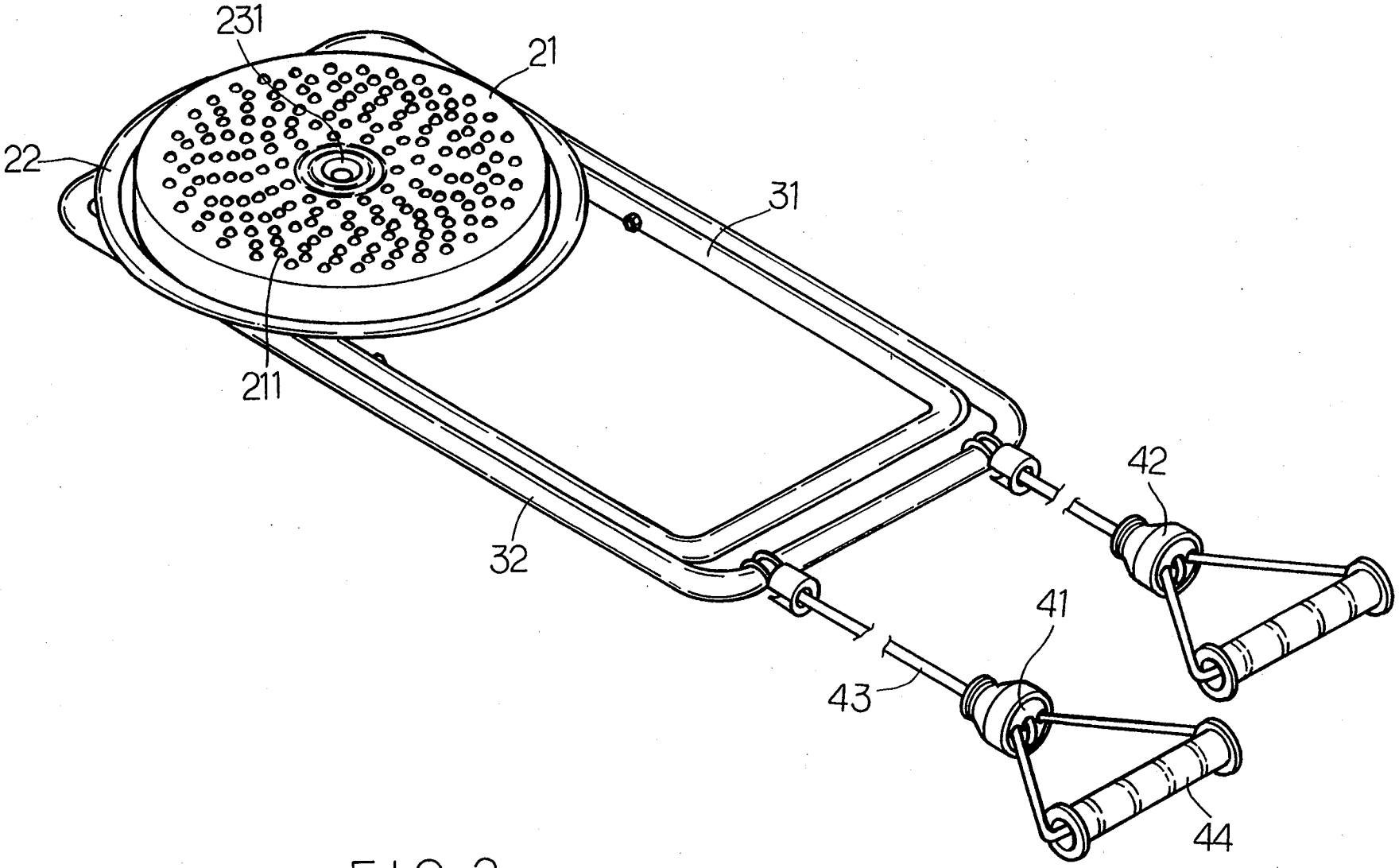
FIG. 2 is an assembly view of the exercising apparatus showing the folding frame collapsed.
Figure 3:
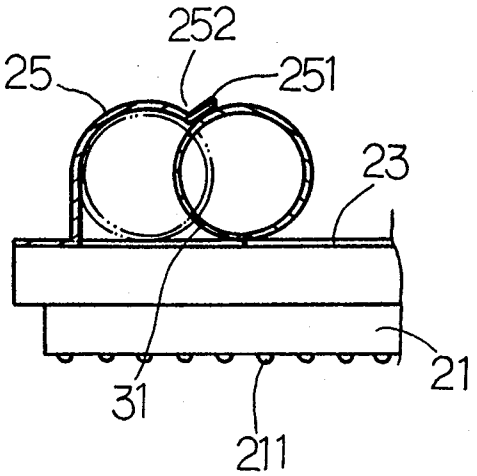
FIG. 3 shows the engagement between the first rectangular frame of the folding frame and the hook spring of the rotary seat according to the present invention.
Figure 4:
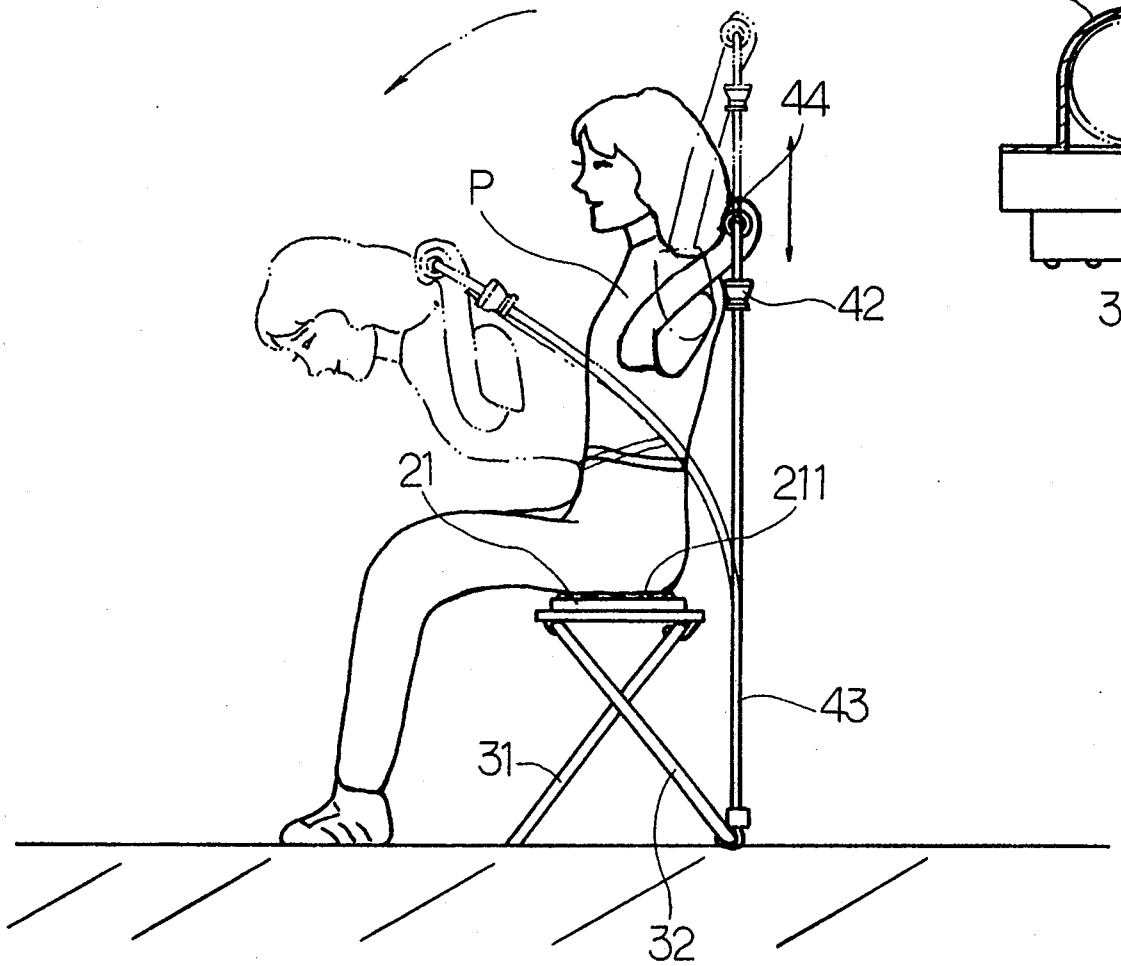
FIG. 4 is an applied view of the exercising apparatus showing the player sitting on the rotary seat to pull the handles.

Referring to FIGS. 1, 2 and 3, an exercising apparatus in accordance with the present invention is generally comprised of a rotary seat 2, a folding frame 3, and a pull rope device 4. The rotary seat 2 comprises a circular base frame 22 having a hollow, upright shaft 231 at the center, and a massaging disk 21 revolvably mounted on the circular base frame 22 around the upright shaft 231 and having a plurality of small, raised portions 211 over the top. The circular base frame 22 of the rotary seat 2 further comprises a barrel 24 (not shown) and hook spring 25 (see FIG. 3) bilaterally mounted on the bottom wall 23 thereof for mounting the folding frame 3. The folding frame 3 comprises two rectangular frames, namely, the first rectangular frame 31 and the second rectangular frame 32 pivoted in the middle. Because the first and second rectangular frames 31 and 32 are pivoted in the middle, they can be collapsed into a flat configuration or set into a crossed shape. The second rectangular frame 32 has one end cut open 321 and fastened to the two opposite ends of the barrel 24, and an opposite end coupled with the pull rope device 4. The first rectangular frame 31 is releasably retained to the hook spring 25. When the first rectangular frame 31 is released from the hook spring 25, the folding frame 3 can be collapsed into the flat configuration and closely attached to the bottom wall 23 of the base frame 22 of the rotary seat 25. When the first rectangular frame 31 is fastened to the hook spring 25, the folding frame 3 is set in the crossed shape to support the rotary seat 2 for sitting (see FIG. 4). The pull rope device 4 comprises two elastic ropes 43 and two handles 44. Each elastic rope 43 has one end coupled to the second rectangular frame 32 and an opposite end inserted through a respective socket 42 and a respective cap 41 and then coupled to either handle 44.

Referring to FIG. 4 again, when the folding frame 3 is set in the crossed shape to support the rotary seat 2, the player P can then sit on the rotary seat 2 to pull the two handles 44. While exercising, the massaging disk 21 is oscillated horizontally causing the raised portions 211 to massage the player's hips.

Figure 5:
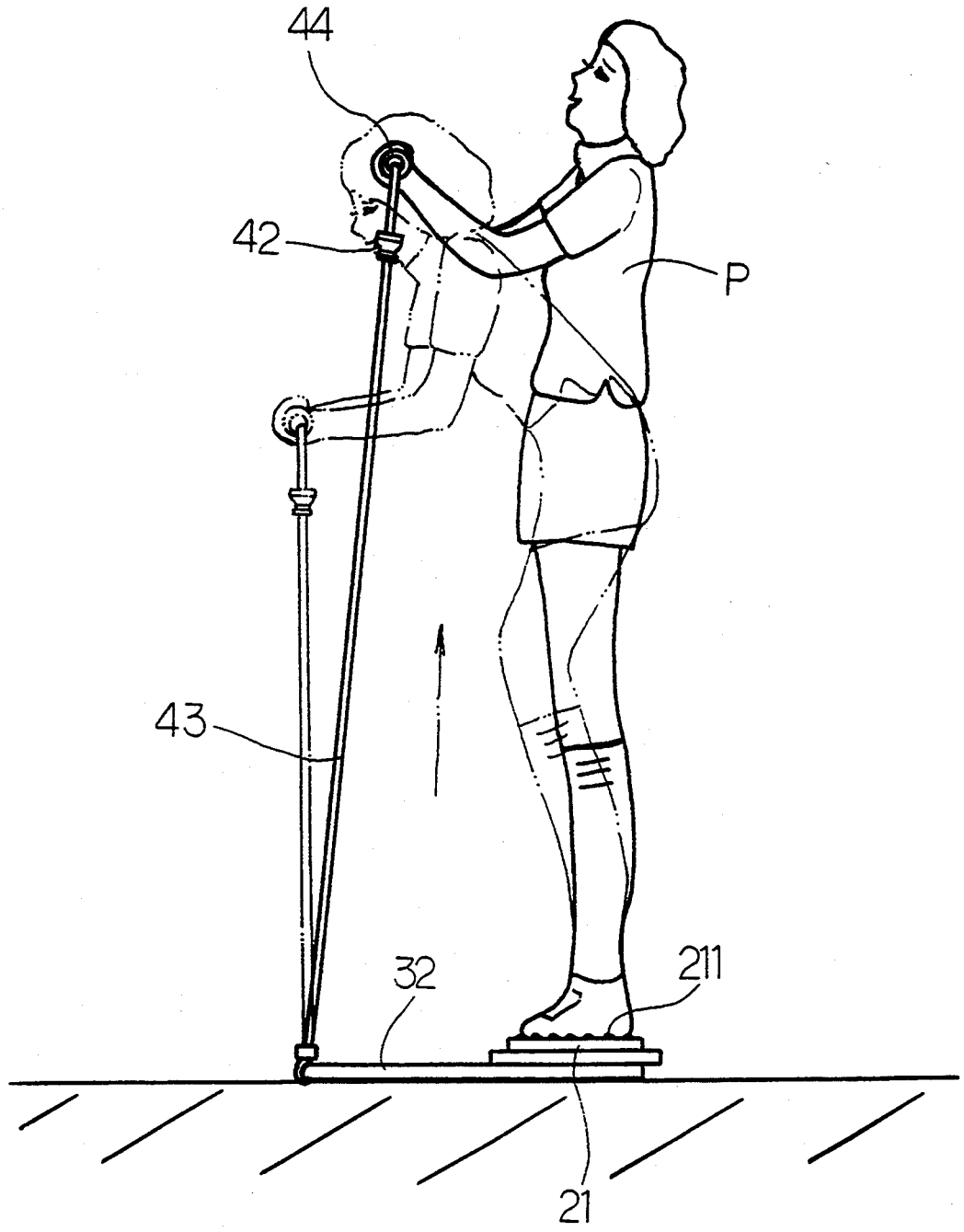
FIG. 5 is another applied view of the exercising apparatus showing the player standing on the rotary seat to pull the handles.

Referring to FIG. 5, when the folding frame 3 is collapsed and placed on the ground, the player P can then stand on the rotary seat 2 to pull the two handles 44.

While only one embodiment of the present invention has been shown and described, it will be understood that various modifications and changes could be made without departing from the spirit and scope of the invention.

What is claimed is:

1. An exercising apparatus comprising:

a rotary seat, which comprises a circular base frame having an upright shaft raised from a top side thereof at the center and a barrel and a retainer means spaced on a bottom side thereof, and a rotary disk mounted on said circular base frame and turned about said upright shaft, said rotary disk having a plurality of raised portions over a top surface thereof for massaging the foot;

a folding frame, which comprises a first rectangular frame and a second rectangular frame pivoted together in the middle, said second rectangular frame having one end hinged to said barrel, said first rectangular frame having one end releasably connected to said retainer means;

two elastic ropes having each one end fastened to an opposite end of said second rectangular frame and an opposite end coupled with a handle for pulling; and wherein said folding frame is collapsed and closely attached to the bottom side of said circular base frame of said rotary seat when said first rectangular frame is released from said retainer means; said folding frame is set in a crossed shape to support said rotary seat when said first rectangular frame is fastened to said retainer means.

2. The exercising apparatus of claim 1 wherein said retainer means is a hook spring.

* * * * *